United States Patent [19]

Hotta et al.

[11] 4,441,863

[45] Apr. 10, 1984

[54] VARIABLE DISCHARGE ROTARY COMPRESSOR

[75] Inventors: Teruyuki Hotta, Nagoya; Yoshiki Kurokawa, Okazaki; Eiichi Nagasaku, Chiryu; Masao Yasunaga, Kariya, all of Japan

[73] Assignee: Nippondenso Co., Ltd., Kariya, Japan

[21] Appl. No.: 342,808

[22] Filed: Jan. 26, 1982

[30] Foreign Application Priority Data

Jan. 27, 1981 [JP] Japan ..... 56-10016[U]
Jan. 27, 1981 [JP] Japan ..... 56-10017[U]

[51] Int. Cl.[3] ..... F04B 49/02; F04B 49/06

[52] U.S. Cl. ..... 417/281; 417/310; 417/505; 62/196.3

[58] Field of Search ..... 417/310, 281, 505; 62/228 C, 196.3

[56] References Cited

U.S. PATENT DOCUMENTS 2,921,530 1/1960 Aumick ..... 417/310
4,336,004 6/1982 Grabb ..... 417/310 X
4,342,199 8/1982 Shaw et al. ..... 417/310 X

*Primary Examiner*—Richard E. Gluck
*Attorney, Agent, or Firm*—Cushman, Darby & Cushman

[57] ABSTRACT

A variable discharge rotary compressor has a housing, a rotor disposed therein and vanes mounted on the rotor to cooperate with the housing and the rotor to define variable volume working chambers disposed close to and separated from an intake chamber by an end wall in which a communication passage is formed to communicate the working chambers with the intake chamber. The communication passage is located at a point where the working chambers are in their compression strokes. A valve is disposed in the communication passage to control the communication between the compression chambers and the intake chamber and is operative to communicate the compression chambers with the intake chamber to permit a part of the fluid in the compression chambers to be returned therefrom back into the intake chamber when the discharge of the compressor exceeds a predetermined discharge requirement. The communication passage is of a very short length so that the fluid passing through the communication passage toward the intake chamber can be prevented from being unduly heated by the heat of the compressor body.

3 Claims, 3 Drawing Figures

VARIABLE DISCHARGE ROTARY COMPRESSOR

BACKGROUND OF THE INVENTION

1. Field of the Invention

The present invention relates to a rotary compressor and, more particularly, to a variable discharge rotary compressor useful to compress refrigerant gas in an automotive air conditioner.

2. Description of the Prior Art

In recent years, compressors have been proposed which are operative to vary the discharge rate so as to reduce the power needed to drive the compressors while providing pleasant air conditioning. One method to vary the discharge rate of a compressor is to provide a bypass through which the refrigerant gas being compressed in a working chamber when in its compressor at a controlled rate. In the conventional rotary compressors, however, it has been difficult to provide the return bypass passages.

More specifically, the conventional type of rotary compressors is arranged such that the working chamber when in its compression stroke is positionally remote from the intake side of the compressor. Thus, the bypass passage is required to have a considerable length. In consequence, the refrigerant gas being returned through the bypass passage towards the intake side of the compressor is disadvantageously heated by the heat of the compressor body. When the heated gas is returned to the intake side of the compressor, the temperature of the refrigerant gas to be sucked into the compressor is raised to adversely affect the performance and durability of the compressor.

SUMMARY OF THE INVENTION

It is an object of the present invention to provide a rotary compressor which is not provided with a considerable length of return bypass passage but is operative to vary the discharge rate.

The variable discharge rotary compressor according to the present invention comprises a generally cylindrical main housing part, end plates provided to close the open ends of the main housing part, a rotor rotatably mounted in the main housing part, a plurality of vanes slidably mounted on the rotor to cooperate with the main housing part, the end plates and the rotor to define working chambers, front and rear housing members provided to cooperate with the end plates to define chambers one of which acts as an intake chamber and the other of which acts as a discharge chamber, the volumes of the working chambers being varied by the rotation of the rotor so that each of the working chambers operates to suck an amount of fluid from the intake chamber, compress the thus sucked fluid and then discharge the thus compressed fluid into the discharge chamber, the end plate adjacent to the intake chamber being provided with a passage means for communicating the intake chamber with the working chambers when they are in their compression strokes, and valve means for controlling the communication between the working chambers and the intake chamber, the valve means being operative to permit the intake chamber to communicate with the working chambers when the discharge of the compressor exceeds a predetermined discharge requirement.

The above and other objects, features and advantages of the present invention will be made apparent by the following description with reference to the accompanying drawings.

DESCRIPTION OF A PREFERRED EMBODIMENT

Figure 1:
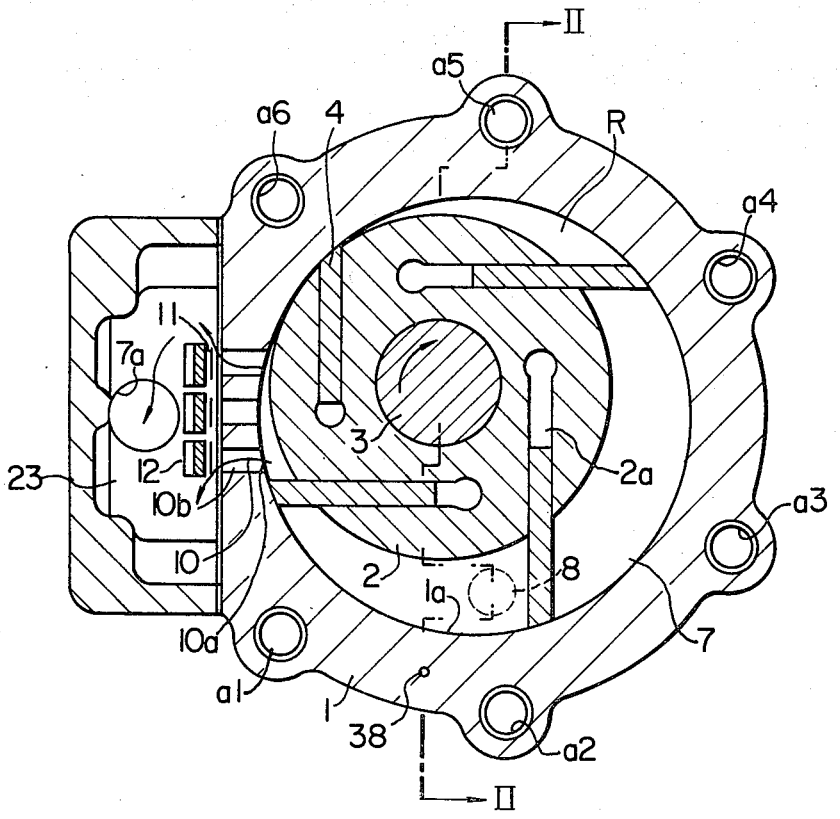
FIG. 1 is a cross-sectional view of an embodiment of the rotary compressor according to the present invention taken along line I—I in FIG. 2.

Referring to the drawings, a rotary compressor in accordance with an embodiment of the invention includes a generally cylindrical main housing part 1 having a cylindrical inner peripheral surface 1*a*. A cylindrical rotor 2 is disposed in the main housing part 1 at an eccentricity from the center of the main housing part 1. A rotor shaft 3 is fitted in and fixed to the rotor 2 so that the latter is rotatable within the main housing part 1 as a unit with the rotor shaft 3. A plurality of vane grooves 2*a* are formed in the outer peripheral surface of the rotor 2 at equal circumferential intervals. In the illustrated embodiment, four vane grooves 2*a* are formed. Each vane groove 2*a* slidably receives a vane 4 which is in sliding contact at its outer end with the inner peripheral surface 1*a* of the main housing part 1.

End plated 6 and 7 are fixed to both ends of the housing 1 with "O" rings interposed therebetween. The rotary shaft 3 is rotatably journaled by these end plates 6 and 7 through bearings 9, 9. A plurality of working chambers R are defined by the cooperation of the end plates 6 and 7, the inner peripheral surface 1*a* of the main housing part 1, the outer peripheral surface of the rotor 2 and the vanes 4. A discharge port means 10 formed in the main housing part 1 opens at its one end 10*a* to one of the working chambers R at one time, and is communicated at its other end with a discharge chamber 23 through the discharge valve 11. Reference numeral 12 denotes a stopper for the discharge valve 11.

Figure 2:
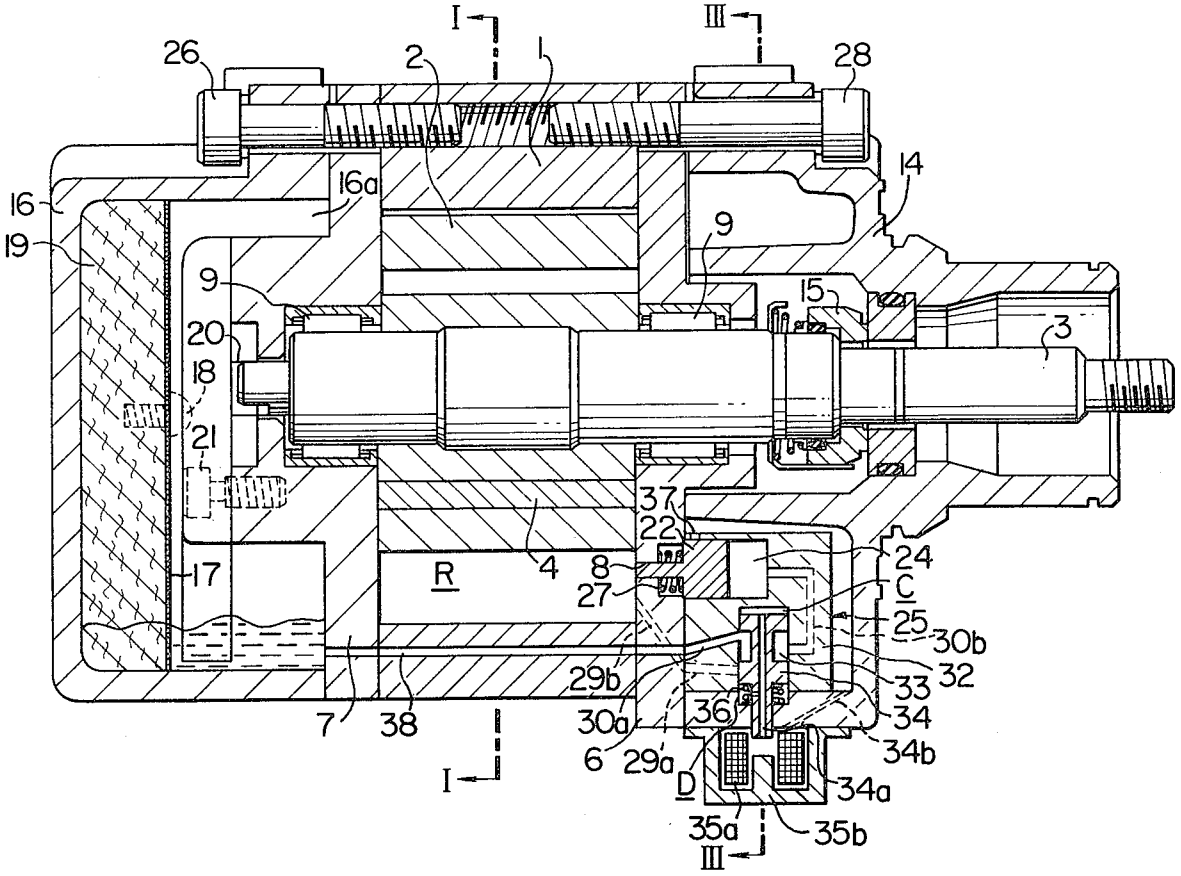
FIG. 2 is an axial sectional view of the compressor taken generally along line II—II in FIG. 1, the valve portion shown in FIG. 2 being taken along line II'—II' in FIG. 3.
Figure 3:
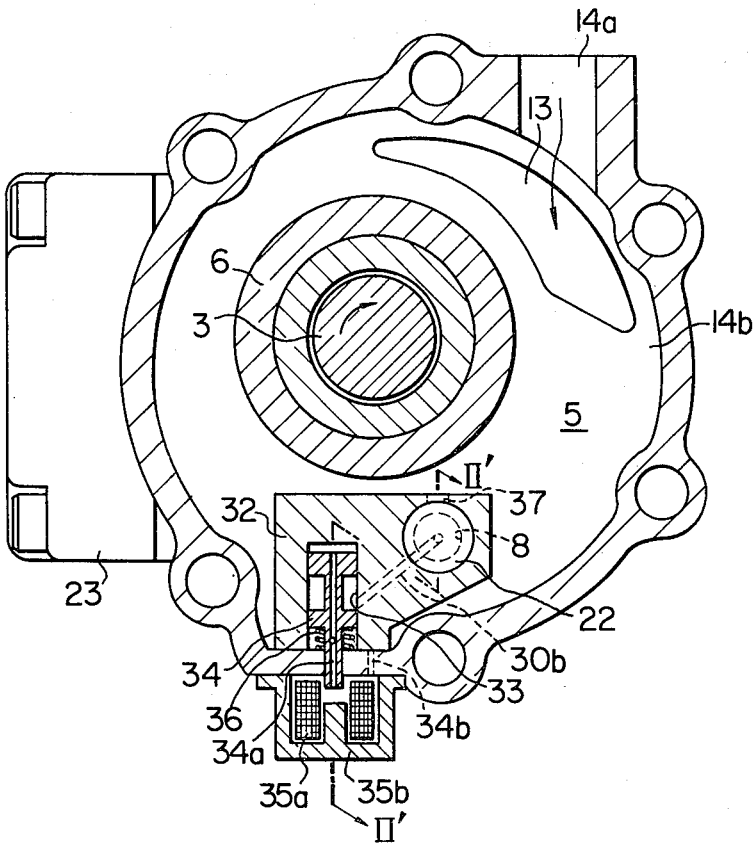
FIG. 3 is a cross-sectional view of the compressor taken along line III—III in FIG. 2.

A cup-shaped front housing member 14 is tightly fixed by means of bolts to one of the end plates 6 and 7 located at the front side (right-handside as viewed in FIG. 2). The end plate 6 will be called hereinunder as "front end plate".

A shaft seal 15 is disposed between the front housing member 14 and the rotor shaft 3 to prevent the lubrication oil and the refrigerant from escaping to the outside of the compressor along the rotor shaft 3.

The compressor further has a rear housing member 16 cooperating with the end plate 7 to define therebetween a sub-discharge chamber 16*a* in which a filter 17 is fixed by means of a screw 18. The chamber 16*a* is communicated with the discharge chamber 23 through a discharge passage port 7*a*. The space between the filter 17 and the rear housing member 16 is filled with an oil separator 19 consisting of non-woven metal cloth. Reference numeral 20 designates a lubricating oil pump fixed to the end plate 7 by means of a bolt 21 and being operative to suck the lubricating oil accumulated in an oil reservoir formed by the lower part of the sub-discharge chamber 16*a* and to forcibly supply the same portions demanding lubrication, such as bearings 9.

The front housing member 14, the end plate 6, the main housing part 1, the end plate 7 and the rear housing member 16 are all made from an aluminum alloy and are united into an assembly by means of bolts 26 and 28 extending through bolt holes a1 to a6 formed in the main housing part 1, as shown in FIG. 1. An intake passage 14*a* is formed in the upper portion of the front housing member 14 and is adapted to introduce a refrigerant gas coming from an evaporator (not shown) of a refrigeration cycle. The front housing member 14 and the front end plate 6 cooperate to define a chamber 5 which serves as an intake chamber. The front end plate 6 is provided with an intake port 13 through which the refrigerant is introduced into a working chamber R which is in its intake phase.

A communication passage 8 is formed in the portion of the front end plate 6 facing a working chamber R in its compression phase so as to communicate the intake chamber 5 with the compression chamber. The communication passage 8 is adapted to be opened and closed by a valve 25 disposed at the end of the communication passage 8 adjacent to the intake chamber 5.

The valve 25 has a valve member 22 made of a material having good sealing characteristics so as to be able to sealingly close the open end of the communication passage 8 adjacent to the intake chamber 5. The valve member 22 is slidably received in a valve chamber 24 formed in a valve housing 32. The valve chamber 24 is communicated with the intake chamber 5 through an apperture 37 formed in the valve housing 32. The valve member 22 is biased by a spring 27 in the direction for opening the communication passage 8. The arangement is such that the lubrication oil accumulated in the oil reservoir in the lower part of the rear housing member 16 is supplied to the valve chamber 24 through a lubrication oil passage 38 formed in the main housing part 1 and the end plates 6 and 7 and also through lubrication oil passages 30*a* and 30*b* formed in the valve housing 32. Since the lubrication oil in the oil reservoir is under the discharge pressure of the compressor, the valve member 22 is moved to the position shown in FIG. 2 for closing the passage 8 when the lubrication oil is supplied to the valve chamber 24 through the passages 38, 30*a* and 30*b*.

The lubrication oil passages 30*a* and 30*b* are adapted to be connected and disconnected to and from each other by means of an oil control or pilot valve 34 which is slidably disposed in a second valve chamber 33 formed in the valve housing 32. When the lubrication oil passages 30*a* and 30*b* are disconnected from each other by the valve member 34, the lubrication oil in the valve chamber 24 is returned to the working chamber R through the lubrication oil passage 30*b* and then through oil relief passages 29*a* and 29*b* formed in the valve housing 32 and in the front end plate 6.

The valve member 34 is resiliently biased by means of a spring 36 towards a position in which the lubrication oil passages 30*a* and 30*b* are communicated with each other. A solenoid 35*a* is provided to actuate the valve member 34 against the force of the spring 36. The arrangement is such that, when a predetermined voltage of a power source is applied to the solenoid 35*a* through lead lines not shown, the valve member 34 is attracted downwardly as viewed in FIG. 2 by the solenoid 35*a* against the force of the spring 36, so that the lubrication oil passages 30*a* and 30*b* are disconnected from each other and the lubrication oil passage 30*b* is brought into communication with the oil relief passage 29*a*. Reference numeral 35*b* designates a solenoid cover adapted to hold the solenoid 35*a*.

The compressor of the invention having the described construction operates in a manner explained hereinunder. When the rotor shaft 3 is driven by a power unit such as an automobile engine, the rotor 2 carrying the vanes 4 is rotated to couse progressive change of volume of each working chamber R. The refrigerant gas which has been introduced from the evaporator (not shown) into the intake chamber 5 through the intake passage 14*a* is sucked into the working chamber when in its suction phase, i.e., the working chamber whose R volume is increasing. As the rotor is further rotated, this working chamber R is disconnected from the intake port 13 and, as the volume of this working chamber is gradually decreased, the refrigerant gas contained in this working chamber R is progressively compressed. The working chamber is then brought into communication with the discharge port 10 when the volume of the working chamber is minimized, so that the compressed gas is discharged to the discharge chamber 23 through the discharge valve 11.

The refrigerant gas compressed and discharged into the discharge chamber 23 flows through the discharge passage port 7*a* in the rear end housing 7 into the sub-discharge chamber 16*a* formed in the rear housing member 16. Then, after the separation and removal of the lubrication oil from the refrigerant by the oil separator 19, the compressed refrigerant gas is recirculated to the condensor (not shown) of the refrigeration cycle through a discharge passage which is omitted from the drawings.

The lubrication oil separated from the refrigerant is collected in the oil reservoir in the rear housing member 16 and is sucked up by the oil pump 20 through an oil port. The oil pump 20 then forcibly supplies the lubrication oil to the portions which need lubrication, such as the bearings 9.

The solenoid 35*a* is not energized when the compressor is operated in normal condition, so that the oil control valve 34 is urged to the uppermost position as viewed in FIG. 2 by the force of the spring 36. The lubrication oil passages 30*a* are 30*b* are therefore held in communication with each other. Then, the lubrication oil under the discharge pressure of the compressor is supplied in to the valve chamber 24 to establish therein an oil pressure which urges the valve member 22 into the position for closing the communication passage 8. In the normal condition of operation, therefore, whole part of the refrigerant introduced into the working chambers R is compressed and discharged.

When the discharge of the compressor is in excess of the discharge requirement by the refrigeration cycle, as in the case of a high-speed operation of the automobile engine for example, such operating condition is detected by suitable sensor means such as the automobile speed sensor, room temperature controller, engine speed sensor, pressure sensor of the refrigeration cycle or the like. The sensor means delivers a detection signal to a relay (not shown) which in turn produces an electric signal for energizing the solenoid 35*a*. In consequence, the oil control valve 34 is lowered against the force of the spring 36 to break the communication between the lubrication oil passages 30*a* and 30*b* and permit the passage 30*b* to communicate with the oil relief passage 29*a*. In consequence, the pressurized lubrication oil which has acted on the back of the valve member 22 is relieved into the working chamber R through the passage 30*b* and via the passages 29*a* and 29*b* due to a pressure differential. This lubrication oil effectively lubricates the sliding parts in each working chamber.

The oil control valve 34 is provided at its center with a through-hole 34*a* which acts as a balancing port for achieving a balance of pressure between an upper space C of the valve chamber 33 and a lower space D. Due to the balance of pressure between two spaces C and D, the electromagnetic force or the spring force required for driving the valve 34 can be of a very small magnitude.

The valve member 22 is moved by the force of the spring 27 to open the communication passage 8 when the back pressure is removed from the valve member. In consequence, a part of the refrigerant in the working chamber R in its compression phase is allowed to escape into the valve chamber 24 through the communication passage 8. In addition, the aperture 37, which is closed by the valve member 22 during the full-load operation, is opened so that the refrigerant is returned from the valve chamber 24 to the intake chamber 5 through the aperture 37.

Thus, the actual compression stroke of each working chamber R is commenced at the moment when the vane 4 located at the trailing end of the working chamber R has just moved past the communication passage 8.

As will be understood from the foregoing description, the discharge rate of the compressor can be varied in accordance with the opening and closing of the communication passage 8. In consequence, the change of the cooling rate as well as the change of the speed of automobile, which are imparted to the persons in the automobile at the time of change of the cooling performance can be made more moderate and more natural as compared with the conventional system in which the cooling performance is controlled by discontinuously operating the compressor.

The selective opening of the communication passage 8 may be achieved by means other than those described above. For instance, it is possible to dispose the solenoid-operated valve 34 at the end of the communication passage 8 adjacent to the intake chamber 5. In this case, however, it is necessary to increase the size and capacity of the solenoid valve because of the large pressure differential between the intake chamber 5 and the working chamber R connected to the communication passage 8 and because of the considerably large diameter of the communication passage 8. Such a large solenoid valve inconveniently requires a large installation space. In the compressor of the described embodiment, however, the opening and closing of the communication passage 8 is achieved by the valve member 22 which is actuated by the pressure of the lubrication oil and the solenoid valve 34 has only to control the application of the pressurized lubricating oil to the valve member 22. The through-hole 34*a* formed in the solenoid valve 34 is operative to balance the pressures in the spaces C and D in the valve chamber 33 and the pressure in the solenoid valve cover 35*b*, thereby to contribute to the reduction of the size and capacity of the solenoid 35*a*. For these reasons, the present invention successfully reduces the size of the compressor as a whole.

The mechanisms for selectively opening and closing the communication passage 8 stated above are not exclusive and it is possible to use other various other constructions for this purpose. For instance, instead of applying the lubrication oil at a high pressure to the back of the valve member 22 as in the described embodiment, it is possible to arrange such that the back of the valve member 22 be subjected to the refrigerant at a pressure higher than the sum of the pressure force of the spring 27 and the internal pressure in the working chamber R facing the communication passage 8. In the described embodiment, when the load on the compressor is reduced, the lubrication oil is relieved from the valve chamber 24 into the working chamber R in the suction phase. The oil, however, may be relieved to any working chamber which is at a pressure lower than the pressure of the lubrication oil or to any portion in the intake chamber 5.

It is also possible to provide a plurality of communication passages 8 and to arrange such that these passages 8 are opened and closed by independent control valves 24. It will be apparent to those skilled in the art that such arrangement permits a more finer control of the discharge rate of the compressor.

The spring 27, which is used in the described embodiment for urging the valve member 22 in the opening direction, may be omitted as required. In such case, however, the valve member 22 is driven by the pressure differential between the cylinder chamber R and the back pressure, so that it is advisable that the communication passage 8 is disposed at a position where the pressure in the working chamber is raised somewhat to a high level. The omission of the spring 27 eliminates the necessity to form the spring retainer in the front end plate 6, so that the fabrication of the front end plate 6 is very much simplified. In addition, the area of contact between the valve member 22 and the front end plate 6 is increased to establish a more tight seal when the communication passage is closed by the valve member 22.

As described above, the rotary compressor according to the present invention is arranged and constructed such that working chambers R disposed close to the intake chamber 5 and separated therefrom solely by the end plate 6 in which the communication passage 8 is formed to communicate the working chambers R with the intake chamber 5. The communication is controlled by the valve member 22 to permit a part of the compressed refrigerant gas to be returned through the communication passage back into the intake chamber. This arrangement and construction assures that the communication passage can be of a very short length and, accordingly, the refrigerant gas passing through the communication passage can be prevented from being unduly heated by the heat of the compressor body.

What is claimed is:

1. A variable discharge rotary compressor comprising:

a housing having a generally cylindrical main housing part, end plates provided to close the open ends of said main housing part, front and rear housing members provided to cooperate with said end plates to define chambers one of which acts as an intake chamber and the other of which acts as a discharge chamber;

a rotor rotatably mounted in said main housing part;

a plurality of vanes slidably mounted on said rotor to cooperate with said main housing part, said end plates and said rotor defining working chambers having volumes which are variable by the rotation of said rotor so that each of said working chambers operates to suck an amount of fluid from said intake chamber, to compress the thus sucked fluid and then to discharge the thus compressed fluid into said discharge chamber;

the end plate adjacent to said intake chamber being formed therein with a first passage means for communicating said intake chamber and the working chambers when in their compression strokes;

a first valve means for controlling the communication through said first passage means between said working chambers in compression strokes and said intake chamber;

said discharge chamber including a section which acts as a reservoir for oil which is under the fluid pressure in said discharge chamber;

a second passage means formed in said housing and extending between said oil reservoir and said first valve means for applying the oil pressure to said first valve means;

said first valve means being responsive to the oil pressure from said oil reservoir to block said first passage means; and a second pilot valve means disposed in said housing to control the application of the oil pressure to said first valve means and having a first position in which the oil pressure is applied through said second passage means to said first valve means when the discharge of said compressor does not exceed a predetermined discharge requirement and a second position in which the oil pressure is not applied to said first valve means when the compressor discharge exceeds said predetermined requirement.

2. A rotary compressor as defined in claim 1, wherein said pilot valve means comprises a solenoid-operated valve member disposed in said second passage means.

3. A rotary compressor as defined in claim 1 or 2, further including:

a pressure relief passage means formed in said housing, said second passage means including a first passage section extending between said oil reservoir and said second pilot valve means and a second passage section extending between said second pilot valve means and said second valve means, said pressure relief passage means having an end adapted to be communicated with said second passage section when said pilot valve means is in said second position, the pressure relief passage means having the other end adapted to be open to said working chambers in which the fluid pressure is lower than the pressure in said discharge pressure.

* * * * *